United States Patent [19]

Boocock

[11] Patent Number: 4,802,886

[45] Date of Patent: Feb. 7, 1989

[54] CONTINUOUS PROCESS FOR THE DYEING OF POLYMERS

[75] Inventor: John R. B. Boocock, Kingston, Canada

[73] Assignee: Du Pont Canada Inc., Mississauga, Canada

[21] Appl. No.: 100,901

[22] Filed: Sep. 25, 1987

[51] Int. Cl.[4] ..... D06P 7/00; D06P 3/79

[52] U.S. Cl. ..... 8/489; 8/513; 8/516; 8/512; 264/78

[58] Field of Search ..... 8/489, 513, 512, 516, 8/536; 264/78

[56] References Cited

U.S. PATENT DOCUMENTS

| | | | |
|---|---|---|---|
| 3,264,272 | 8/1966 | Rees | 260/78.5 |
| 3,864,315 | 2/1975 | Ohno et al. | 8/539 |
| 4,369,039 | 1/1983 | Coates | 8/513 |
| 4,612,155 | 9/1986 | Wong et al. | 264/176 R |

FOREIGN PATENT DOCUMENTS 0207205 1/1987 European Pat. Off. .

*Primary Examiner*—Paul Lieberman
*Assistant Examiner*—Christine A. Skane

[57] ABSTRACT

A continuous process for the dyeing of melt-extrudable polymers that are capable of being dyed, is disclosed. The process comprises extruding molten polymer through an orifice, contacting the extruded polymer while still in a molten state with an aqueous solution of a dye for said polymer, and withdrawing the resultant dyed polymer from the aqueous solution. The process may be used for the dyeing of e.g. modified polyolefins, polyamides, ionomers and the like. In preferred embodiments the process may be used in the extrusion coating of wire or other continuous filamentary material to provide color-coded products.

11 Claims, No Drawings

CONTINUOUS PROCESS FOR THE DYEING OF POLYMERS

The present invention relates to a continuous process for the dyeing of polymers and especially for the dyeing of blends of polyolefins and polymers containing carboxylic acid and certain other polar groups.

A wide variety of polymers e.g. polyamides, polyesters and polyolefins are known. Such polymers, which include homopolymers of ethylene and copolymers of ethylene with $C_4$–$C_{10}$ alpha-olefins, are used in large volumes for a variety of end-uses e.g. in the form of fibres, films, moulded articles and the like. If fabricated articles are desired in a colour other than the natural colour of the polymer, it is often possible to pigment the polymer or to print the fabricated article. In some instances, it is desirable or even necessary to be able to dye the fabricated article. In general, hydrocarbon polyolefins are not receptive to dyes, although techniques to render polyolefins receptive to dyes are known, including introduction e.g. by copolymerization, of polar monomers into the polymer. One such technique, in which blends of hydrocarbon polyolefins and polar polymers are dyed with basic dyes, is disclosed in published European patent application No. 0 207 205 of J. R. B. Boocock and V. G. Zboril, published 1987 Jan. 07, The techniques for the production of fabricated articles having colours other than the natural colour of the polymer have involved extrusion of polymer containing pigment, dye or the like, or the printing or dyeing of the fabricated article.

A continuous process for the dyeing of melt-extrudable polymers having polar groups, and especially blends of hydrocarbon polymers and polymers having polar groups, has now been found.

Accordingly, the present invention provides a continuous process for the dyeing of melt-extrudable polymers capable of being dyed, said process comprising extruding molten polymer through an orifice, contacting the extruded polymer while still in a molten state with an aqueous solution of a dye for said polymer, and withdrawing the resultant dyed polymer from the aqueous solution.

In a preferred embodiment of the process of the present invention, the polymer is a polyolefin that is a blend comprising (i) 70–99 parts by weight of a homopolymer or copolymer of hydrocarbon alpha-olefins having 2–10 carbon atoms, especially a polyethylene selected from the group consisting of homopolymers of ethylene and copolymers of ethylene with $C_4$–$C_{10}$ higher alpha-olefins, and mixtures thereof, and (ii) 1–30 parts by weight of a copolymer selected from the group consisting of direct copolymers and graft copolymers wherein (a) said direct copolymer is the copolymer of an alpha-olefin having the formula $R—CH{=}CH_2$, where R is a radical selected from the class consisting of hydrogen and alkyl radicals having from 1 to 8 carbon atoms, with at least one alpha, beta-ethylenically unsaturated carboxylic acid having from 3 to 8 carbon atoms, the acid moeities being randomly or non-randomly distributed in the polymer chain, the carboxylic acid content being 0.5–50% by weight of the direct copolymer, any other copolymerized monomer being monoethylenically unsaturated, (b) said direct copolymer is a copolymer of (a) in the form of an ionomer, and (c) said graft copolymer is obtained by grafting 0.1 to 20 percent by weight of at least one alpha-, beta-unsaturated carboxylic acid having 3 to 8 carbon atoms or unsaturated carboxylic acid anhydride onto a preformed polyolefin backbone derived from ethylene or ethylene and $C_3$ to $C_8$ alpha-olefin, in which polyolefin backbone any other optionally copolymerized monomer component is monoethylenically unsaturated, with the proviso that in blends containing direct copolymers the minimum amount of direct copolymer is 2 parts by weight, and said aqueous solution contains basic or disperse dye at a pH of 5.0–7.5.

In another embodiment of the present invention, the polyolefin blend also contains 0.2–2% by weight of white pigment, especially titanium dioxide.

In a further embodiment, the polymer is a polyamide, a polyester, a direct copolymer as defined above, an ionomer of such a direct copolymer, a graft copolymer as defined above, or other polar polymer, blends thereof or blends thereof with a hydrocarbon polymer derived from at least one monomer of the o formula $R—CH{=}CH_2$, where R is as defined above, in which event the dye may be an acid dye, a basic dye, a disperse dye or other type of dye, as is appropriate for the dyeing of the polymer.

The present invention is directed to melt-extrudable dyeable polymers but will be further described with particular reference to the dyeing of a polyethylene blend.

The polyethylene of the blend may be a homopolymer of ethylene and/or a copolymer of ethylene with at least one hydrocarbon alpha-olefin having 4–10 carbon atoms, e.g. a copolymer of ethylene with a minor amount of butene-1, hexene-1 and/or octene-1.

The characteristics of the polyethylene will depend to a large extent on the intended end-use of the resultant products. For instance the density may range from about 0.890 g/cm$^3$ to about 0.965 g/cm$^3$ and the melt index, as measured by the method of ASTM D-1238 (Condition E) may range up to about 200 dg/min. The ranges of density and melt index, and of related parameters, of polyethylenes that are useful for various types of products are known to those skilled in the art.

The blend also contains a copolymer which may be a direct copolymer or a graft copolymer. The direct copolymer may be a copolymer of an alpha-olefin having the formula $R–CH{=}CH_2$, where R is a radical selected from the group consisting of hydrogen and alkyl radicals having from 1 to 8 carbon atoms, with at least one alpha, beta- ethylenically unsaturated carboxylic acid, especially ethylenically unsaturated monocarboxylic acid, having from 3 to 8 carbon atoms. The acid moieties may be randomly or non-randomly distributed in the polymer chain. The carboxylic acid content of the copolymer is 0.5–50% by weight of the copolymer. Such direct copolymers are known and include copolymers of ethylene with acrylic acid, methacrylic acid, monomethyl ester of maleic acid and the like. For example, Nucrel ®acid copolymers are available from E.I. du Pont de Nemours and Company of Wilmington, Del., U.S.A.

The direct copolymers may also be in the form of ionomers formed from the acid copolymers referred to above. Such ionomers are also known and are, for example, available under the trade mark Surlyn from E.I. du Pont de Nemours and Company and described in detail in U.S. Pat. No. 3 264 272 of R. W. Rees, which issued 1966 Aug. 02. For instance, it is known to form ionomers of acid copolymers using salts of sodium or zinc. The dyeability of blends of polyethylene and ionomer may be dependent to a significant extent on the metal ion in the ionomer. For instance, it is generally preferred to use ionomers containing zinc rather than ionomers containing sodium.

The acid copolymer may be a graft copolymer obtained by grafting 0.1 to 20, especially 0.1 to 2.0, percent by weight of at least one alpha, beta-unsaturated carboxylic acid, including dicarboxylic acids, having 3 to 8 carbon atoms or unsaturated carboxylic acid anhydride onto a preformed polyolefin backbone derived from ethylene or ethylene and $C_3$ to $C_8$ alpha-olefin. Any other optionally copolymerized monomer component of the polyolefin backbone is monoethylenically unsaturated. For example, the graft copolymer may be a homopolymer of ethylene or a copolymer of ethylene with a $C_4$–$C_8$ hydrocarbon alpha-olefin that has been grafted with e.g. acrylic acid, methacrylic acid, maleic acid, fumaric acid, itaconic acid, crotonic acid or maleic anhydride. Alternatively, the graft copolymer may be formed by grafting such an acid or anhydride onto polypropylene, poly-4-methyl pentene-1 or other hydrocarbon polymer. Techniques for the preparation of grafted copolymers are known in the art, preferred examples of which are disclosed in U.S. Pat. No. 4 612 155 of C. S. Wong and R. A. Zelonka, issued 1986 Sept. 16. Blends of grafted copolymers are available from Mitsui Petrochemical Industries under the trade mark Admer.

The blend comprises 70–99 parts by weight of the polyethylene and 1–30 parts by weight of the acid copolymer provided, however, that in blends containing direct copolymers the minimum amount of direct copolymer is 2 parts by weight. In a preferred embodiment, the blend comprises 80–97 parts by weight of the polyethylene and 3–20 parts by weight of the acid polymer.

In an alternate embodiment of the present invention, the polymer may be a homopolymer or copolymer of alpha-olefins having 2–10 carbon atoms, including homopolymers and copolymers of propylene, poly-4-methyl pentene-1 and the like. In a further embodiment, the polymer may be a polyamide, examples of which are polyhexamethylene adipamide, polyhexamethylene sebacamide, polycaprolactam and other known polyamides, including copolyamides formed from the monomers of such polyamides. The polymer may also be a polyester, examples of which are polyethylene terephthalate and polybutylene terephthalate. The polymer may also be a direct, ionomeric or graft copolymer described above.

The polymer may be a blend of a polyolefin derived from at least one monomer of the formula $R—CH{=}CH_2$, where R is a radical selected from the class consisting of hydrogen and alkyl radicals having from 1 to 8 carbon atoms, with another, polar, polymer. Such blends may also contain a so-called compatibilizer, as is known for blends of hydrocarbon and polar polymers.

In the process of the present invention, the polymer is heated until it is in a molten state. For example, the polymer may be fed to an extruder, or other extrusion device, adapted for the extrusion of molten polymer and equipped with an orifice through which the molten polymer may be extruded. The orifice may for example be circular, and adapted for extrusion of molten polymer of substantially circular cross-section and of a variety of diameters, including circular orifices adapted for the extrusion coating of wire or other strand material e. g. glass fibres, or the orifice may be other than circular in shape, for example, adapted for the extrusion of tapes, film or the like. In a preferred embodiment of the present invention, the orifice is especially adapted for extrusion coating of wire or other continuous filamentary material.

The molten polymer is extruded through the orifice and, while still in a molten state, is contacted with an aqueous solution containing dye. The dye may be any dye capable of being used in the form of an aqueous solution and suitable for the dyeing of the polymer extruded through the orifice. In the dyebath, the molten polymer is both dyed and cooled to a temperature that is below temperatures at which the resultant fabricated article is capable of becoming distorted. Subsequently, the dyed polymer or article is optionally rinsed or subjected to other process steps and then usually wound up, as will be understood by those skilled in the art.

In a preferred embodiment, in which the polymer is the polyolefin blend described above, the dye may be in the form of an aqueous solution that contains a basic or disperse dye. Although it is believed that any basic or disperse dye generally may be used, it is to be understood that major differences exist between such dyes in the ability of the dye to dye the polymers defined herein, as is disclosed in the aforementioned published application of J. R. B. Boocock and V. G. Zboril. For instance, the hue and relative depth of dyeing obtained may differ significantly from the hue and relative depth of dyeing obtained with the same dye in the dyeing of, for instance, acrylic polymers. Such differences may be advantageous or disadvantageous, depending on the result that is being sought. The hue and relative depth may also differ with the dyeing conditions used e.g. concentrations, pH and temperature. Examples of suitable dyes include Sandrocryl ®Brilliant Yellow B-6GL, Sandrocryl Brilliant Red B-4G, Sandrocryl Brilliant Blue B-BLE and Sandrocryl Brilliant Red B-F.

In embodiments in which the dye is a basic dye, the concentration of dye in the dyebath is at least 0.05 g/l and especially 2–5 g/l. However, the concentration that should be used will depend on the extent of dyeing of the article, the nature of the polymer blend and the particular dye selected. The pH of the dyebath is at least 5.0, especially 5.5–7.0, but the preferred pH may depend on the particular dye selected; pH is measured at the temperature of the dyebath. The temperature of the dyebath must be such that the extruded polymer or fabricated article does not become significantly distorted while in the dyebath. The dye must be selected so that it has adequate stability under the dyeing conditions. It is preferred that the dyebath does not contain so-called levellers or retarders, or a minimal amount thereof, which is contrary to practice in the dyeing of acrylic fibres. In the dyeing of polyethylene, levellers should be used only under the most favourable circumstances.

With other polymers, either acid, basic or other types of dyes may be used, depending on the nature of the polymer. Such dyes will be understood by those skilled in the art.

The process of the present invention may be used in a variety of end-uses but it is particularly applicable to the dyeing of polymer-coated wire or filamentary material. The process affords a versatility in the colouring of such coated wire and filamentary material that may not be available with, for example, coating using pigmented polymers. In the dyeing of coated wire or other filamentary material, it may be convenient to utilize the aqueous solution of dye in a form other than in a dye bath e.g. as a spray or a sponge wet with the aqueous solution.

The dyeing process of the present invention may result in dyed articles that are not dyed throughout the thickness of the article, and may in some circumstances be only dyed at or near the surface of the article. The nature of the dye, the dyeing conditions and the composition that is being dyed are all believed to be factors affecting the penetration of dye into the polymer.

The present invention is illustrated by the following examples.

EXAMPLE I

An admixture of Surlyn®9950 ionomer (10% by weight) and Sclair®2907 polyethylene (90% by weight) was fed to a twin-screw extruder; the polyethylene was a linear ethylene homopolymer i.e. having a density of about 0.960 g/cm$^3$, with a melt index of 5.0 dg/min. The resultant blend was extruded as a strand of molten polymer through an orifice of a size to produce a strand about 3 mm in diameter and directly into a dye bath; the gap between the orifice and dye bath was approximately 10 cm and the rate of extrusion was between about 0.05 and 0.4 m/sec. The dyed and solidified strand passed from the dye bath, over a sponge to remove liquid from the surface of the strand, through a water bath and was then pelletized using a rotary cutter.

The dyebath contained Sandrocryl®Brilliant Yellow B-6GL dye.

The colour of the dyed pelletized polymer was measured with a Hunterlab Colorimeter, using the "b" value obtained as an indication of the depth of dyeing.

Further details and the results obtained were as follows:

| Run No. | Dye Conc. (g/l) | Dyebath Temp. (°C.) | Dyebath Contact Time (sec) | Pellet Colour "b" Value |
|---|---|---|---|---|
| 1 | 0 | — | 0 | 9.6 |
| 2 | 3.6 | 15 | 1.8 | 29.4 |
| 3 | 3.6 | 18 | 1.4 | 38.8 |
| 4 | 3.6 | 19 | 0.8 | 38.5 |
| 5 | 3.6 | 20–25 | 1.8 | 38.3 |
| 6 | 3.6 | 26–32 | 1.8 | 39.9 |
| 7 | 3.6 | 32–35 | 1.7 | 41.6 |
| 8 | 3.6 | 50–65 | 1.7 | 43.6 |
| 9 | 10.8 | 30–35 | 2.0 | 42.9 |
| 10 | 10.8 | 40–64 | 1.9 | 43.3 |
| 11 | 10.8 | 66–74 | 4.2 | 43.0 |
| 12 | 10.8 | 74–76 | 4.2 | 43.2 |

The results show that the strand was dyeable under the conditions used. The concentration of dye appeared to have little effect on the colour of the resultant pellet, within the above concentration range. Similarly, the colour was relatively insensitive to dyebath temperatures and contact times over substantial portions of the ranges tested.

The above procedure was repeated using a dyebath containing 3.6 g/l of Sandrocryl Brilliant Blue dye at a pH of 6.5 and a bath temperature of 75° C. The dyed pellets obtained were dyed blue.

EXAMPLE II

In a comparative experiment, using the procedure of Example I, polyethylene was extruded into a dyebath that contained Sandrocryl Brilliant Yellow B6GL dye at a concentration of 3.6 g/l and a pH of 6.5. The temperature of the dyebath was 95°–100° C. When the polyethylene was a blend of 80% by weight of Sclair 2907 polyethylene and 20% by weight of Surlyn 9950 ionomer, the polyethylene was dyed to a "b" level, as measured on the Hunterlab Colorimeter, of 24. In contrast, when the polyethylene was 100% by weight of Sclair 2907 polyethylene, the "b" value obtained was 2.4. This example illustrates that polyethylene without added copolymer is not dyed to any significant extent using the process of the present invention.

In further comparative experiments, it was found that plaques formed by injection moulding mixtures of the ionomer and polyethylene were not significantly dyed in a dyebath containing Sandrocryl Brilliant Yellow B6GL dye at a pH of 6.5 and a temperature of 25° C., after a period of 30 minutes.

I claim:

1. A continuous process for the dyeing of melt-extrudable polymers capable of being dyed, said process comprising extruding molten polymer through an orifice, contacting the extruded polymer while still in the molten state with an aqueous solution of a dye for said polymer, and withdrawing the resultant dyed polymer from the aqueous solution, said polymer being selected from the goup consisting of:

A. a polyamide;

B. a polyester;

C. a direct copolymer that is a copolymer of an alpha-olefin having the formula R—CH=CH$_2$, where R is a radical selected from the class consisting of hydrogen and alkyl radicals having from 1 to 8 carbon atoms, with at least one alpha, beta-ethylenically unsaturated carboxylic acid having from 3 to 8 carbon atoms, the acid moieties being randomly or non-randomly distributed in the polymer chain, the carboxylic acid content being 0.5–50% by weight of the direct copolymer, any other copolymerized monomer being monoethylenically unsaturated;

D. an ionomer of a direct copolymer;

E. a graft copolymer obtained by grafting 0.1 to 20 percent by weight of at least one alpha-, beta-unsaturated carboxylic acid having 3 to 8 carbon atoms or unsaturated carboxylic acid anhydride onto a preformed polyolefin backbone derived from ethylene or ethylene and C$_3$ to C$_8$ alpha-olefin, in which polyolefin backbone any other optionally copolymerized monomer component is monoethylenically unsaturated; and F. blends of at least one C, D or E with a hydrocarbon polymer derived from at least one monomer of the formula R—CH=CH$_2$, where R is as defined above.

2. The process of claim 1 in which the polymer is a polyolefin that is a blend comprising (1) 70–99 parts by weight of a homopolymer or copolymer of a hydrocarbon alpha-olefin having 2–10 carbon atoms, and mixtures thereof, and (ii) 1–30 parts by weight of a copolymer selected from the group consisting of direct copolymers and graft copolymers wherein (a) said direct copolymer is the copolymer of an alpha-olefin having the formula R—CH=CH$_2$, where R is a radical selected from the class consisting of hydrogen and alkyl radicals having from 1 to 8 carbon atoms, with at least one alpha, beta-ethylenically unsaturated carboxylic acid having from 3 to 8 carbon atoms, the acid moeities being randomly or non-randomly distributed in the polymer chain, the carboxylic acid content being 0.5–50% by weight of the diret copolymer, any other copolymerized monomer being monoethylenically unsaturated, (b) said direct copolymer is a copolymer of (a) in the form of an ionomer, and (c) said graft copolymer is obtained by grafting 0.1 to 20 percent by weight of at least one alpha-, beta-unsaturated carboxylic acid having 3 to 8 carbon atoms or unsaturated carboxylic acid anhydride onto a preformed polyolefin backbone derived from ethylene or ethylene and $C_3$ to $C_8$ alpha-olefin, in which polyolefin backbone any other optionally copolymerized monomer component is monoethylenically unsaturated, with the proviso that in blends containing direct copolymers the minimum amount of direct copolymer is 2 parts by weight, and said aqueous solution contains basic or disperse dye at a pH of 5.0–7.5.

3. The process of claim 2 in which, in (i), the homopolymer or copolymer is a polyethylene selected from the group consisting of homopolymers of ethylene and copolymers of ethylene with $C_4$–$C_{10}$ higher alpha-olefins, and mixtures thereof.

4. The process of claim 2 in which the blend also contains 0.2–2% by weight of titanium dioxide.

5. The process of claim 3 in which the blend also contains 0.2–2% by weight of titanium dioxide.

6. The process of claim 2 in which the graft copolymer contains 0.1 to 2.0% by weight of said acid or anhydride.

7. The process of claim 2 in which, in (ii), the copolymer is a copolymer of (a).

8. The process of claim 2 in which, in (ii), the copolymer is a copolymer of (b).

9. The process of claim 2 in which, in (ii), the copolymer is a copolymer of (c).

10. The process of claim 1 in which the extruded polymer is in the form of a coating on wire or other continuous filamentary material.

11. The process of claim 2 in which the extruded polymer is in the form of a coating on wire or other continuous filamentary material.

* * * * *